United States Patent [19]

McNamara, Jr.

[11] 4,364,105

[45] Dec. 14, 1982

[54] STACKED FIXTURES WITH ANGULARLY POSITIONED LAMPS AND DOWNWARDLY LIGHT-DIRECTING REFLECTORS

[75] Inventor: Albert C. McNamara, Jr., San Marcos, Tex.

[73] Assignee: Esquire, Inc., New York, N.Y.

[21] Appl. No.: 249,951

[22] Filed: Apr. 1, 1981

Related U.S. Application Data

[63] Continuation of Ser. No. 35,438, May 3, 1979, abandoned.

[51] Int. Cl.[3] ..... F21S 3/00

[52] U.S. Cl. ..... 362/224; 362/225; 362/237; 362/240; 362/241; 362/297; 362/346; 362/348; 362/347; 362/367; 362/375

[58] Field of Search ..... 362/31, 210, 263, 292, 362/297, 299, 300, 301, 304, 328, 341, 346, 349, 350, 367, 431, 347, 348, 221-225, 237, 240, 241

[56] References Cited

U.S. PATENT DOCUMENTS

| | | | |
|---|---|---|---|
| 1,680,036 | 8/1928 | Tartas | 362/292 |
| 3,059,106 | 10/1962 | Moser | 362/366 |
| 3,445,647 | 5/1969 | Peter | 362/330 |
| 3,610,915 | 10/1971 | Moore | 362/431 |
| 3,638,010 | 1/1972 | Moore | 362/304 |
| 3,666,934 | 5/1972 | Moore | 362/294 |
| 3,944,810 | 3/1976 | Grindle | 362/346 |
| 4,002,894 | 1/1977 | Kintz | 362/261 |
| 4,106,083 | 8/1978 | Wolf | 362/346 |
| 4,143,412 | 3/1979 | Sassmannshausen | 362/346 |
| 4,159,511 | 6/1979 | Dejonc | 362/804 |

OTHER PUBLICATIONS

Catalogue Publication #BD-15M-01-777, Gardco Manufacturing Co., Entitled "Wall Brackets" (Hereinafter, Gardco).

*Primary Examiner*—Harold J. Tudor
*Attorney, Agent, or Firm*—Vaden, Eickenroht, Thompson, Bednar & Jamison

[57] ABSTRACT

An improved light fixture comprising a housing adapted for tower or pole top mounting and having preferably stacked upper and lower lamp compartments. One reflector in each compartment includes a segment that is located partly behind and partly over a symmetrically positioned lamp included therein so as to reflect light therefrom downwardly and outwardly through a window in a side wall opposite to the reflector. Another reflector similarly located reflects light through a second window in an opposite side wall. Windows in the other two side walls also receive light emanations from the lamp. The axis to the lamp in each compartment is substantially horizontal and is skewed with respect to the side wall windows. The lamp in one compartment is preferably complementarily positioned with respect to the lamp in the other compartment.

7 Claims, 3 Drawing Figures

FIG. 1
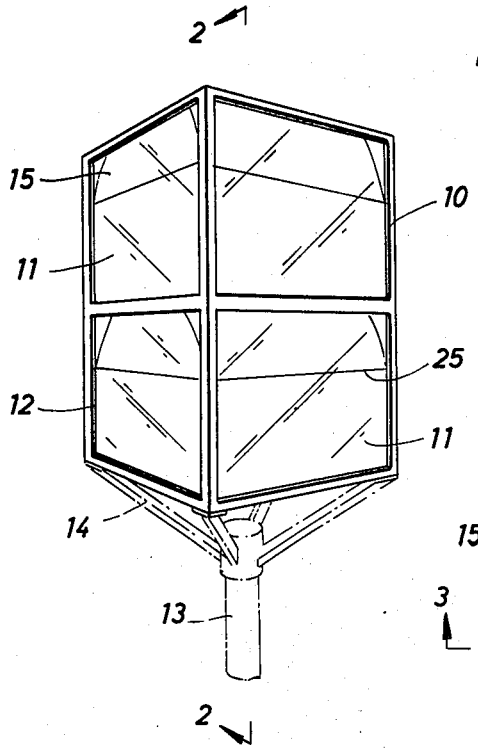
FIG. 2
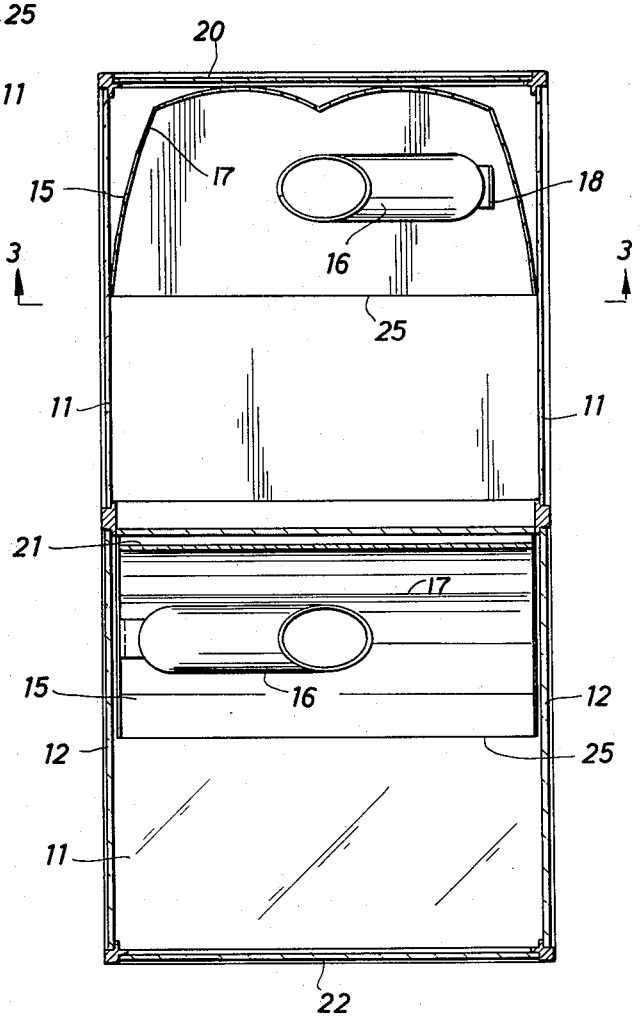
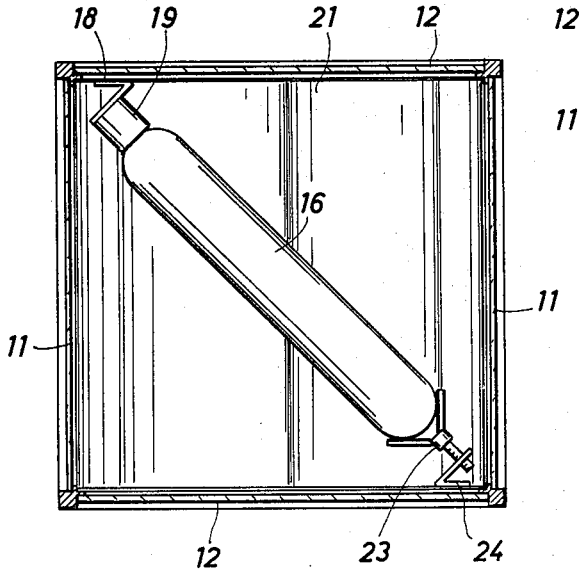
FIG. 3

STACKED FIXTURES WITH ANGULARLY POSITIONED LAMPS AND DOWNWARDLY LIGHT-DIRECTING REFLECTORS

This is a continuation of application, Ser. No. 35,438, filed May 3, 1979, now abandoned.

BACKGROUND OF THE INVENTION

1. Field of the Invention

This invention pertains to lighting fixtures and more particularly to an improved high mounted, side-window light fixture, which may be of the stacked variety.

2. Description of the Prior Art

Light fixtures housing sodium vapor, metal halide or other high intensity gaseous discharge lamps for providing general illumination to a large area, such as, for example, to a parking lot or an athletic playing area, are desirably mounted high above the area for long range lighting. However, the areas to be illuminated have corners, borders and the like. Universally reflecting light fixtures located in these positions provide light for the intended area, but also appreciable light from such fixtures is directed away from the intended area, which is not an efficient or productive use of light. Even light fixtures positioned in the middle of the area are relatively non-productive when a major portion of the light therefrom is projected upwards or straight out. That is, the most desirable light is generally outward and downward.

Moreover, light emanating from a fixture through a lens at a low angle undergoes a relatively larger amount of reflection back into the fixture than light emanating at a high angle. Therefore, by example, a light fixture with a bottom lens opening directs its most efficient light straight down. The light which exits at the exit pupil, on the other hand, is at the lowest angle of exit of any of the light and has, accordingly, a greater percentage of its light reflected at the lens than light reflected at the middle of the opening. Since the purpose of the high mounted light is to provide good general, wide-area ground illumination, it has been discovered that fixtures with vertical or side windows are generally the most suitable for this purpose. This is because for the light further out, the higher the angle through the window and the lesser is the amount of reflection. For the light closer in, the light is at a higher reflective angle, but the distance covered is less. Therefore, the overall brightness is generally satisfactory.

Also, it is often desirable to position more than one light fixture on a single tower or other installation to obtain maximum use of the number of installations that need to be made while increasing the number of fixtures in service, and hence the number of lamps, thereby making it possible to share ballast and other electronic components, as well as affecting the sharing of the mechanical installation components. When light fixtures are installed one on top of another, the installation is referred to as a "stacked fixture", which stack may include more than two lamp compartments.

One such stacked fixture structure is shown in U.S. Pat. No. 3,638,010, commonly assigned with the present application. In this structure, each compartment includes an upper and a lower reflector. The upper reflector is in two segments, each segment located generally over and outward from the lamp terminating at the top of a window. Light from the lamp is reflected outwardly and downwardly from a reflector segment through the adjacent window. There are windows on opposite sides of the compartment, hence light is reflected from the respective segments through both of these oppositely disposed windows.

The bottom curved reflector provides some secondary reflection from the lamp back to the top reflector segments to supply additional light downwardly and outwardly through the windows. However, because the reflector segments terminate near the top of their respective windows, there is a great deal of light from the light source that is unproductively projected outwardly but not downwardly, and some of which is even projected upwardly.

Light emanating from a lamp which is generally aligned with its elongate axis parallel with a parabolic reflector, the type of reflector which is generally desirable for producing parallel directed light rays from a fixture, produces a rather abrupt light change at the projection of the exit image.

It has long been known that by skewing a bulb in a cylindrical fixture so that the elongate axis thereof is not parallel with the edges of the window exit, sharp shadows can be greatly reduced. It has not been previously recognized that skewing a light bulb in a side-window fixture in such a manner so that the axis is not parallel with the plane of the window accomplishes the reduced shadow effect without detracting from the high reflective angle, light production discussed above.

Therefore, it is a feature of the present invention to produce an improved stacked fixture for emanating light outwardly and downwardly without wastefully directing light non-productively in other directions.

It is another feature of the present invention to provide an improved side-window fixture that eliminates abrupt changes of light at edges of light fixtures by placing the lamp therein at a skew angle with respect to the light fixture opening, thereby also reducing of fixture window size.

SUMMARY OF THE INVENTION

The invention described herein pertains to a side-window lighting fixture, preferably having two or more stacked compartments, each compartment having one or more side wall windows. The reflector in each compartment includes one or more reflector segments secured to the housing, such reflector being positioned at least partially over and partly behind a symmetrically positioned lamp mounted in the compartment so as to direct at least a major portion of the light emanating therefrom outwardly and downwardly through the window opposite such reflector. A portion of the light is reflected forward through the near window. Even when there are oppositely disposed windows through which light is reflected from the fixture in two opposing directions, this arrangement of reflector-with-respect-to-window permits downward and outward reflection underneath the reflector segment partially covering the front of the lamp so as to provide the desired opposite reflection.

The preferred embodiment includes two or more stacked compartments, each compartment having window openings on all four sides. Two cylindrical reflector segments in each compartment direct light primarily toward windows opposite from each other and two top parabolic reflectors in each compartment direct light both toward the opposite window and to the near window. Some direct light and reflected light also emanates from the side windows.

The lamp in each compartment is preferably positioned so that its elongate axis is skew with respect to each of the side window planes to minimize the effects of an abrupt light distribution change caused by the image of the window exit.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the appended drawings illustrate only a typical embodiment of the invention and are therefore not to be considered limiting of its scope, for the invention may admit to other equally effective embodiments.

In the drawings:

FIG. 1 is a perspective pictorial illustration of a preferred embodiment of the invention disclosed herein.

FIG. 2 is a cross-sectional view taken at section line 2—2 of the embodiment of the invention illustrated in FIG. 1.

FIG. 3 is an internal view of the housing showing the placement of the light source taken along section line 3—3 of the embodiment illustrated in FIG. 2.

DESCRIPTION OF THE PREFERRED EMBODIMENT

Now referring to the drawings, and first to FIG. 1, a rectangular shaped light fixture of the stacked variety is illustrated in perspective. Housing 10 comprising at least two chambers or compartments stacked on top of each other is attached to a base pole 13. One illustrated convenient method of attaching such housing to a base pole which is easily implemented and which results in a fixture sufficiently stable to withstand adverse weather conditions is to bolt or spot weld a plurality of prongs intermediate to the bottom of housing 10 and to the top of pole 13.

Each compartment of housing 10 has at least one and preferably four side wall windows 11 opposite each other for the exit of luminous flux. A reflector system 15 located at the top of the compartment directionally reflects luminous flux from an internal light source. This source is typically a mercury vapor or other high intensity discharge lamp having an elongate arc, symmetrically positioned within the reflector system in a manner more completely described hereinafter. Side wall windows 11, as illustrated, are entirely made of transparent material even though luminous flux is precluded from exiting the upper portion of windows 11 of the compartment by a portion of reflector system 15, which curvilinearly extends downwardly from the middle of the compartment until bottom edge 25 is substantially tangent to window 11.

Reflector 15 is in two halves. Each half comprises two reflector segments partly behind and partly above the light source. The lower segment is fluted by parallel grooves 17, for convenience, so that the reflections therefrom are not all at exactly the same angle, but are spread. The primary reflections from each of the fluted incremental segments are outwardly and downwardly across the reflector through the opposite window. The upper segment is parabolic and is positioned so as to reflect some light from the source across to the opposite window and so as to reflect some light from the source forward through the near window.

The interval reflector system is open on the sides adjacent side windows 12; however, a shield or blanking panel at the top of the window effectively screens light from emanating through the top portion of these windows and makes the resulting appearance of each window approximately uniform. Alternatively, only two windows can be provided, which still provides fairly uniform circumferential lighting when the window openings of the upper and lower compartments are complementary or at 90° angles with respect to one another.

FIG. 2 is a cross-sectional view of the stacked light fixture illustrated in FIG. 1. Roof 20 and bottom window 22 complete the external structure of the housing by covering and sealing their respective ends of housing 10 at the perimeter formed by side wall windows 11 and side wall windows 12, thus rendering the resultant fixture weathertight. Relamp doors (not illustrated) or similar conventional means can be provided for servicing the light fixture. A compartment divider, such as divider plate 21, provides internal support for housing 10, as well as preventing stray light from migrating between compartments.

The source of luminous flux for the light fixture is preferably provided by a plurality of elongated high intensity gaseous discharge lamps 16, with each compartment preferably having one such lamp. Elongated lamps 16 are placed in the upper portion of their respective compartments, diagonally or skewedly positioned with respect to both side wall windows 11 and side wall windows 12. The light axes of elongated lamps 16 are substantially parallel to roof 20, divider plate 21 and bottom window 22, the benefit of which will become apparent.

Luminous flux is reflected downwardly and outwardly by one or more reflectors located partly above and partly behind elongated lamps 16. A particularly convenient method of reflecting such luminous flux is by shaping a continuous rectangular piece of relatively rigid specular material capable of being shaped by bending and thereafter retaining such shape. As discussed above, this procedure permits the formation of the incremental fluted segments of the two lower reflector segments as well as the two top, parabolic shaped segments. The resultant reflector 15 is preferably sufficiently large to transverse the area between side wall windows 11 and side wall windows 12 above elongated lamps 16. Two side edges of reflector 15 preferably run along side and are tangent to side wall windows 12 while the other two edges are tangent to side wall windows 11. The top reflector segments are each parabolic and meet with each other along a line perpendicular to side wall windows 12 and meeting in the center of the compartment between windows 11. By extending the lower segments of reflector 15 below the light axis of elongated lamps 16, reflected light is precluded from being skywardly emitted as it exits opposite side wall windows 11. The angle of downward reflection is determined by the distance between the light axes of elongated lamps 16 and reflector bottom edge 25 in conjunction with the extent of downward protrusion of reflector 15 along side wall window 11. Reflector 15 is secured to housing 10 by any conventional means such as spot welding or bolting selected areas where reflector 15 is tangent to roof 20.

Side window reflecting is at a high angle, typically in the range of 68° to the plane. Regular glass that has a high index of reflection may be used. Note that, by contrast, bottom opening reflectors will emenate light at lower and lower angles. Regular glass is almost totally reflective at 22° or less. Hence, the reflector system described above achieves a much greater coverage.

Bottom window 22 permits light straight downward, even though the pole structure blocks some of this window.

Placement of elongated lamps 16 in a skewed or diagonal position with respect to side wall windows 11 and 12 reduces abrupt light projection changes from bright to dark. Light emanating from conventional light fixtures where the lamp is generally aligned with its elongate axis parallel with a parabolic reflector results in direct light on a uniform axial plane. Reflected light reinforcing the direct light is also found on the same or relatively proximate axial plane, where light intensity of both direct and indirect light decreases proportionately on an outward plane until abruptly ceasing as the particular housing edge blocks the light. In a skewed lighting system, as distance from the light fixture increases, a point is reached where direct light will begin to cease, but this is done gradually albeit for a short distance, proportionately decided by the length of the elongated lamp and distance from the fixture, until eventually all direct light is extinguished. Indirect light is also slowly extinguished, with the distance over which light intensity is reduced being determined by the size of the reflector and the distance and angle of reflection. More specifically, reflected light, although blocked by the reflector opposite the reflecting side, does not end abruptly due to the veering angle of reflection resulting from the skewed placement of the light source above the lowermost part of the reflector. The same effect takes place for illumination of areas proximate to the base of the mounting pole for the stacked light fixture.

FIG. 3 is an internal view of the upper compartment of housing 10 illustrating with particularity the diagonal or skewed placement of elongated lamp 16. Electrical socket 19 is rigidly held by one wing of a substantially V-shaped support 18. V-shaped support 18 is parallel to roof 20 and affixed to side wall 12 by bolting, spot welding, or other conventional means, in such a manner that the outside surface of the second wing faces toward the opposite corner of the compartment. One wing of a second V-shaped support 24 is similarly attached to the side wall diagonally opposite to where V-shaped support 18 is attached. The angles formed by V-shaped support 18 and V-shaped support 24 should each preferably approximate 45°, while aggregating to 90°. Light support 23 is adjustably attached to such second wing of V-shaped support 24 permitting longitudinal movement along the longitudinal lamp axis of elongated lamp 16. Although various conventional light supports may be used, illustrated light support 23 preferably has desirable heat insulating and cushioning surfaces arranged in a generally conical pattern as is further described in U.S. Pat. No. 3,781,539.

While particular embodiments of the invention have been shown and described, it will be understood that the invention is not limited thereto, since many modifications may be made and will become apparent to those skilled in the art. For example, a series of reflector strips attached to and extending downwardly from the roof of each compartment could be used to directionally reflect light downwardly and outwardly through the exit window.

I claim:

1. A light fixture for bidirectional long range illumination of ground surfaces without significant light-dark boundaries and with reduced shadow effects comprising:

(a) a housing adapted to be mounted in an upright position above the ground surface and said housing having parallel opposite placed vertical windows in a rectangular lamp compartment;

(b) an electrical socket in said compartment to receive the electrical end of a lamp having an elongated arc, and said lamp placed substantially horizontally with its axis residing diagonally across said lamp compartment between said windows;

(c) reflector means carried on the inner side at the top of said lamp compartment;

(d) said reflector means comprising side by side reflector halves symmetrically positioned relative to a center line of the top of said lamp compartment, each reflector half including a parabolic reflector segment extending laterally from the middle of the top of said lamp compartment to adjacent said windows and a cylindrical reflector segment extending downwardly from each said parabolic reflector segment and terminating tangentially at said window adjacent thereto, whereby each said parabolic reflector segment reflects light from said lamp towards both near and opposite windows and each said cylindrical reflector segment reflects light primarily across said light compartment through said window opposite to it.

2. The light fixture of claim 1 wherein said cylindrical reflector segments are fluted whereby light is reflected at a multitude of angles through said window opposite thereto.

3. The light fixture of claim 1 wherein said cylindrical reflector segments reflect light through said window opposite thereto at a high angle relative to the ground plane, and said angle being about 68 degrees.

4. The light fixture of claim 1 wherein said lamp compartment has said lamp positioned diagonally between the vertical edges at the intersecting windows.

5. The light fixture of claim 1 wherein said cylindrical reflector segments extend downwardly along said windows to below the light axis of said lamp whereby reflected light is precluded from being emitted skywardly as it exits said windows opposite to said cylindrical reflector segments.

6. The light fixture of claim 1 wherein:

(a) the bottom of said lamp compartment is a divider plate to prevent stray light from migrating downwardly therefrom, and including;

(b) a second housing adapted to be mounted in an upright position beneath said housing but above the ground surface and said second housing having parallel opposite placed vertical windows in a second rectangular lamp compartment;

(c) an electrical socket in said second compartment to receive the electrical end of a lamp having an elongated arc, and said lamp placed substantially horizontally with its axis residing diagonally across said lamp compartment between said windows;

(d) reflector means carried on the inner side of said divider plate at the top of said second lamp compartment;

(e) said reflector means comprising side by side reflector halves symmetrically positioned relative to said lamp, each reflector half including a parabolic reflector segment extending laterally from the middle of said second lamp compartment to adjacent said windows and a cylindrical reflector segment extending downwardly from each said parabolic reflector segment and terminating tangentially at said window adjacent thereto, whereby each said parabolic reflector segment reflects light from said lamp towards both near and opposite windows and each said cylindrical reflector segment reflects light primarily across said second light compartment through said window opposite to it.

7. The light fixture of claim 5 wherein said lamp in said second light compartment is placed on an axis diagonally to the axis of said lamp in the first mentioned light compartment.

* * * * *